US009819068B2

(12) United States Patent
Kocurek et al.

(10) Patent No.: US 9,819,068 B2
(45) Date of Patent: Nov. 14, 2017

(54) TIME DELAY UNIT COMPRISING A SPIRALLY WOUND MEANDERING LINE PATTERN

(71) Applicant: Raytheon Company, Waltham, MA (US)

(72) Inventors: Patrick J. Kocurek, Allen, TX (US); Robert S. Isom, Allen, TX (US)

(73) Assignee: RAYTHEON COMPANY, Waltham, MA (US)

( * ) Notice: Subject to any disclaimer, the term of this patent is extended or adjusted under 35 U.S.C. 154(b) by 279 days.

(21) Appl. No.: 14/482,077

(22) Filed: Sep. 10, 2014

(65) Prior Publication Data

US 2016/0072172 A1 Mar. 10, 2016

(51) Int. Cl.

| | |
|---|---|
| ***H01P 9/00*** | (2006.01) |
| ***H01P 9/02*** | (2006.01) |
| ***H01P 11/00*** | (2006.01) |

(52) U.S. Cl.

CPC ..... *H01P 9/006* (2013.01); *H01P 9/02* (2013.01); *H01P 11/003* (2013.01)

(58) Field of Classification Search

CPC .... H01P 9/00; H01P 9/006; H01P 9/02; H01P 1/184; H01P 1/18; H01P 11/003

USPC ..... 333/161

See application file for complete search history.

(56) References Cited

U.S. PATENT DOCUMENTS

| | | | | |
|---|---|---|---|---|
| 4,675,625 | A * | 6/1987 | Johnston | H01P 9/00 333/161 |
| 4,675,626 | A * | 6/1987 | Etzel | H01P 9/00 174/562 |
| 4,675,627 | A * | 6/1987 | Johnston | H01P 9/00 333/161 |
| 4,783,359 | A * | 11/1988 | Fleischer | H01P 9/00 174/255 |
| 7,026,891 | B2 * | 4/2006 | Mazzochette | H01P 11/00 333/156 |
| 7,561,006 | B2 * | 7/2009 | Dutta | H01L 23/66 333/156 |
| 8,628,493 | B2 | 1/2014 | Ahn et al. | |

OTHER PUBLICATIONS

Luchnikov et al., "Toroidal hollow-core microcavities produced by self-rolling of strained polymer bilayer films", Journal of Micromechanics and Microengineering, vol. 18, No. 3, 2008.

* cited by examiner

*Primary Examiner* — Benny Lee
(74) *Attorney, Agent, or Firm* — Cantor Colburn LLP

(57) ABSTRACT

An electronic stripline circuit includes a flexible dielectric film having a three-dimensional coiled shape that defines a spiraled inner core. At least one electrically conductive signal trace is formed on a first surface of the flexible dielectric film. The signal trace extends along a signal path to define a trace length configured to control a time delay of a coiled time delay unit.

13 Claims, 8 Drawing Sheets

TIME DELAY UNIT COMPRISING A SPIRALLY WOUND MEANDERING LINE PATTERN

TECHNICAL FIELD

The present disclosure relates generally to radio frequency antenna systems, and more particularly, to a compact three-dimensional time delay unit.

BACKGROUND

Radio frequency (RF) antennas can include a time delay unit that allows the RF antenna to perform over a broad range of frequencies. Conventional time delay units include a rigid printed wiring board (PWB) having electrically conductive signal traces patterned thereon to form a delay line. The length of the delay line determines the value of the time delay of the antenna. For example, extending the length of the delay line increases the time delay of the antenna. A delay line having an extended length, however, increases the overall size of the PWB. As a result, the locations at which to dispose the time delay unit are limited to areas capable of fitting the PWB.

SUMMARY OF THE INVENTION

According to one embodiment, an electronic stripline circuit includes a flexible dielectric film having a three-dimensional coiled shape that defines a spiraled inner core. At least one electrically conductive signal trace is formed on a first surface of the flexible dielectric film. The signal trace extends along a signal path to define a trace length configured to control a time delay of a time delay unit.

According to another embodiment, a time delay unit comprises an electrically conductive stripline including at least one electrically conductive signal trace formed thereon. The stripline has a three-dimensional coiled shape that defines a spiraled inner core. A printed wiring board includes at least one electrically conductive board trace conductively formed on the at least one signal trace.

Additional features are realized through the techniques of the present invention. Other embodiments are described in detail herein and are considered a part of the claimed invention. For a better understanding of the invention and the features, refer to the description and to the drawings.

BRIEF DESCRIPTION OF THE SEVERAL VIEWS OF THE DRAWINGS

For a more complete understanding of this disclosure, reference is now made to the following brief description, taken in connection with the accompanying drawings and detailed description, wherein like reference numerals represent like parts.

DETAILED DESCRIPTION OF THE INVENTION

Various embodiments of the invention provide a meandering electrically conductive signal trace formed on a flexible dielectric film. The flexible dielectric film is rolled upon itself to form a three-dimensional (3-D) time delay unit (TDU) having a coiled cylindrical structure hereinafter referred to as a "jelly roll" structure. The delay length of the jelly roll TDU can be scaled by adjusting the length and width of the flexible dielectric film and the number of meandering paths that extend along the width of the flexible dielectric film. In this manner, the jelly roll TDU allows for a delay line having an increased delay line length, while still providing a compact TDU that can be disposed in compact areas.

Figure 1A:
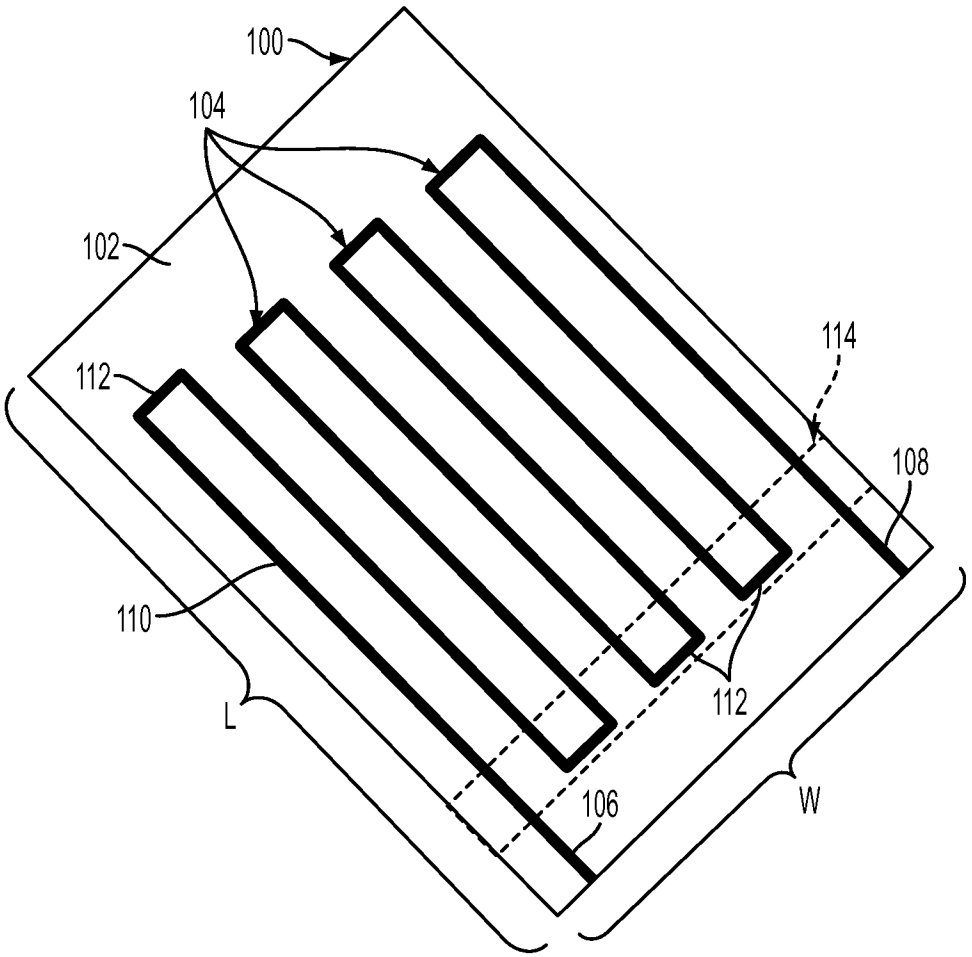
FIG. 1A is a top view of an unrolled stripline including a flexible film layer having a meandering signal trace patterned thereon to form a time delay unit according to an exemplary embodiment.

Referring to FIG. 1A, a perspective view of an unrolled stripline circuit 100, i.e., a stripline 100, for forming a coiled, i.e., jelly roll, TDU is illustrated according to an exemplary embodiment. The stripline 100 includes a flexible dielectric film 102 having an electrically conductive signal trace 104 formed thereon. The flexible dielectric film 102 extends along a first direction to define a length (L) and a second direction perpendicular to the first direction to define a width (W). According to an embodiment, the flexible dielectric film 102 is formed from, for example, liquid crystal polymer (LCP). The flexible dielectric film 102 has a thickness ranging from, for example, approximately 0.001 inches to approximately 0.01 inches. As the thickness of the flexible dielectric film 102 increases, RF loss is reduced. The flexible dielectric film 102 can be formed from various dielectric materials including, but not limited to, LCP, poly (4,4'-oxydiphenylene-pyromellitimide), or other flexible dielectrics.

The flexible dielectric film 102 includes, for example, a metal clad layer formed on one or more surfaces (e.g., opposing upper and lower sides) thereof. The metal clad layer is, for example, 0.5 ounce (oz) copper having a thickness typically ranging from approximately 9 micrometers (μm) to approximately 18 μm, for example, as understood by one of ordinary skill in the art. It is appreciated that other metal thicknesses and materials could be used. For example, copper may have various weights including, but not limited to, 0.25 oz, 0.5 oz, 1 oz, and 2 oz weights. According to an embodiment, a bottom metal clad layer can be patterned to form a ground plane (not shown) while a top metal clad layer can be patterned to form the electrically conductive signal trace 104. The signal trace 104 has a meandering pattern, for example, that extends between a first terminal end 106 and a second terminal end 108. According to an embodiment, the signal trace 104 is formed by photo-etching the top metal clad layer, as understood by one of ordinary skill in the art.

Figure 1B:
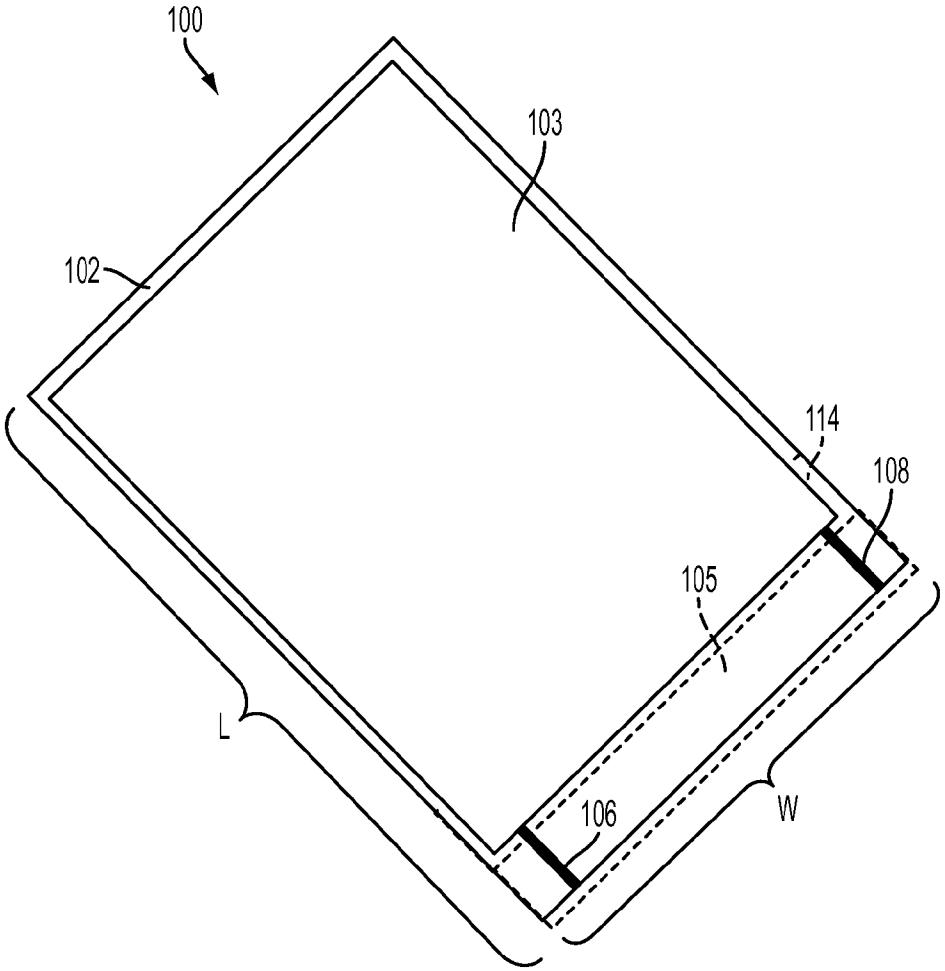
FIG. 1B is a top view of the unrolled stripline of FIG. 1A with a second dielectric layer disposed on an upper surface of the flexible film layer.

Turning to FIG. 1B, a second dielectric layer 103 is disposed on top of the flexible dielectric layer 102 and covers the signal trace 104 (FIG. 1A) described above to form an upper portion of the stripline 100. The second dielectric layer 103 is formed from, for example, a flexible LCP material. According to an embodiment, the second dielectric layer 103 covers a first portion of the flexible dielectric layer 102, while exposing a second portion of the flexible dielectric layer 102 at an area 105 between the end of the signal trace 104. The area exposing the flexible dielectric layer 102 provides greater accessibility to the first terminal end 106 and a second terminal end 108 as discussed in greater detail below.

According to an embodiment, the first terminal end 106 and the second terminal end 108 are disposed on a common side of the flexible dielectric film 102. In this case, the signal trace 104 meanders in a direction extending along the width of the flexible dielectric film 102 to form a plurality of lengthwise portions 110 separated by each other by one or more bent portions 112, as shown in FIG. 1A. The width of each individual bent portion 112 defines the distance between a pair of adjacent lengthwise portions 110. As mentioned above, the second dielectric layer 103 is cut back such that the first and second terminal ends 106/108 extend from region 114 (FIGS. 1A and 1B) of the flexible dielectric film 102. Accordingly, the first terminal end 106 and the second terminal end 108 can be easily accessed and electrically connected to a printed wiring board (PWB) as discussed in greater detail below.

Figure 2A:
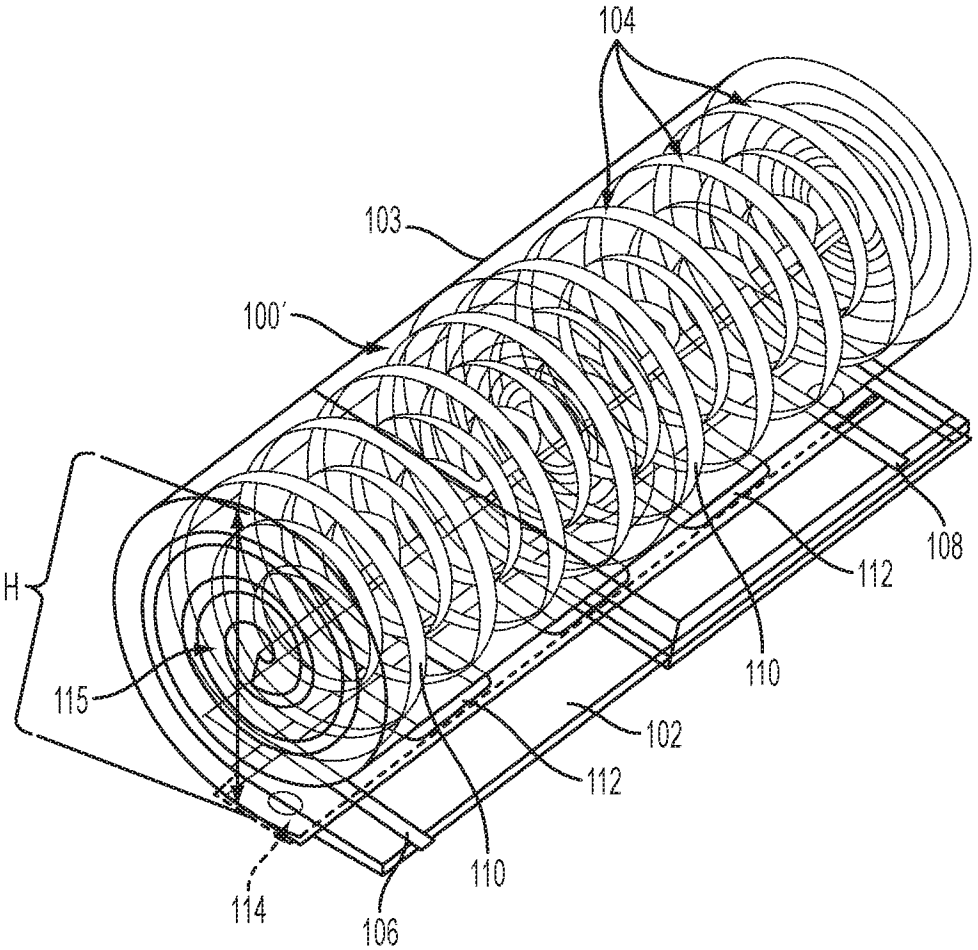
FIG. 2A is a perspective view of the stripline illustrated in FIGS. 1A-1B after rolling the stripline upon itself to form a three-dimensional coiled stripline.
Figure 2B:
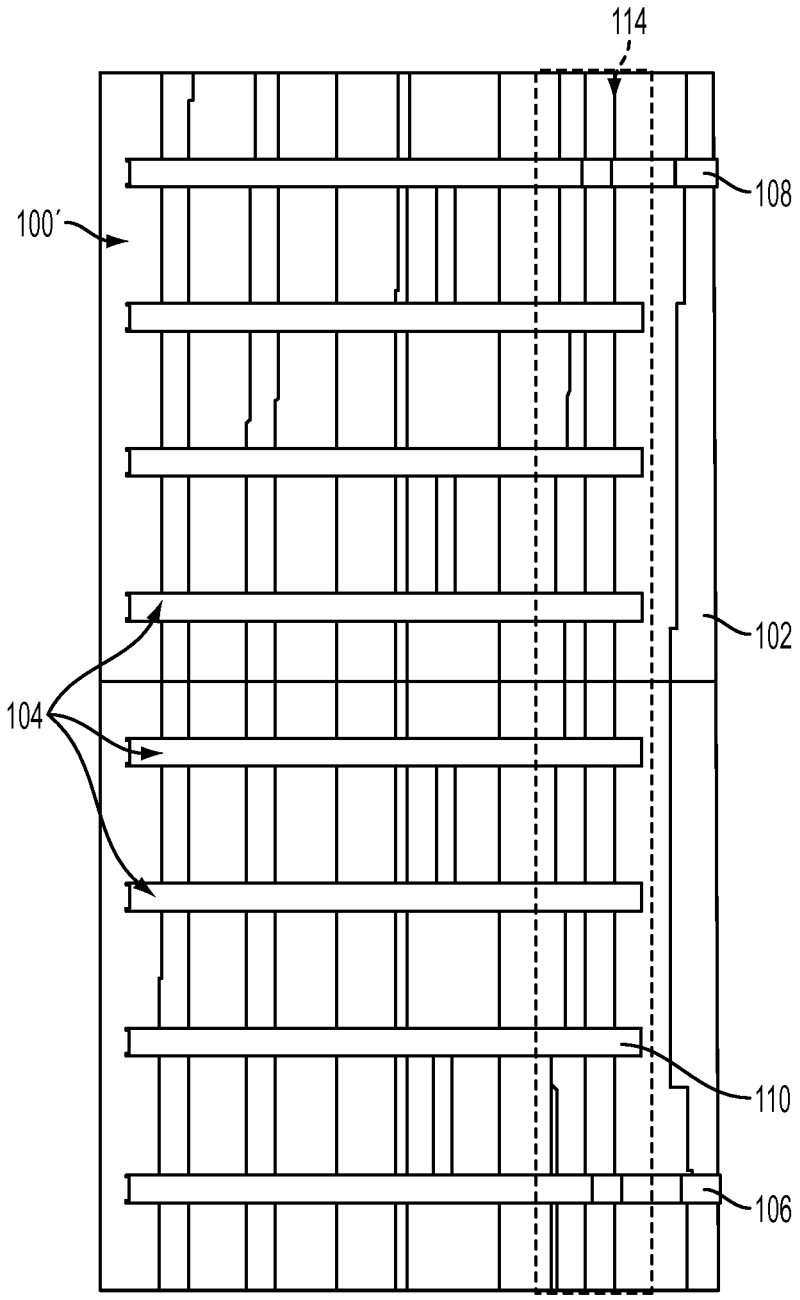
FIG. 2B is top view of the three-dimensional coiled stripline illustrated in FIG. 2A.

Referring to FIGS. 2A and 2B, the stripline is illustrated after rolling the flexible dielectric film 102 upon itself to form a three-dimensional jelly roll stripline 100' having a spiraled inner core 115 (FIG. 2A). In this manner, the delay time provided by the jelly roll stripline 100' can be scaled by adjusting the distance of the lengthwise portions 110 extending in the length (L) direction (FIGS. 1A and 1B) and/or varying the number of bent portions 112 (FIG. 2A) extending the width (W) direction (FIGS. 1A and 1B). The stripline 100' can be rolled using a mandrel rolling process. The mandrel rolling process includes coupling a first end of the flexible dielectric film 102 to a cylindrical rod with a slot formed therein. The rod defines the minimum coil diameter to ensure the signal trace 104 is not damaged or cracked when rolling the stripline 100'. An end of the stripline 100' is inserted in the slot and the stripline 100' is wrapped once around the mandrel. Tension is then applied to the opposite end of the stripline 100' and the cylindrical rod is rotated about its center lengthwise-axis such that the flexible dielectric film 102 and the second dielectric layer 103 (not shown in FIG. 2B for clarity) are rolled around the rod and upon one another to form the three-dimensional jelly roll stripline 100' shown in FIGS. 2A and 2B. The rolled jelly roll stripline 100' defines a height (H) as shown in FIG. 2A According to an embodiment, the flexible dielectric film 102 and the second dielectric layer 103 are not laminated until after the rolling process, leaving them free to slide against each other, which allows them to be rolled more tightly without causing stress. Accordingly, the flexible dielectric film 102 and the second dielectric layer 103 are prevented from buckling and the metal layers are prevented from delaminating from the dielectric layer. After the flexible dielectric film 102 and the second dielectric layer 103 are rolled, they are laminated together to ensure close contact. Keeping the flexible dielectric film 102 and the second dielectric layer 103 separate also enables the use of a thicker dielectric materials (i.e., layers), which minimizes RF loss. Although fabrication of a single rolled stripline circuit 100' is illustrated, it is appreciated that multiple stripline circuits 100' can be fabricated simultaneously (i.e., side-by-side) in one long roll. Individual stripline 100' can then be singulated (sliced), thereby reducing fabrication costs.

The stripline 100' also has a top ground surface layer and a bottom ground surface layer. According to a non-limiting embodiment, the bottom ground surface layer of one coil (i.e., layer) of the rolled stripline 100' also serves as the top ground surface layer of the next coil. Therefore, it is unnecessary for the second dielectric layer 103 to include a patterned metal film layer (i.e., the second dielectric layer 103 can be formed as a bare dielectric film), enabling the stripline 100' to be wrapped tighter, further reducing the circuit size.

Figure 3A:
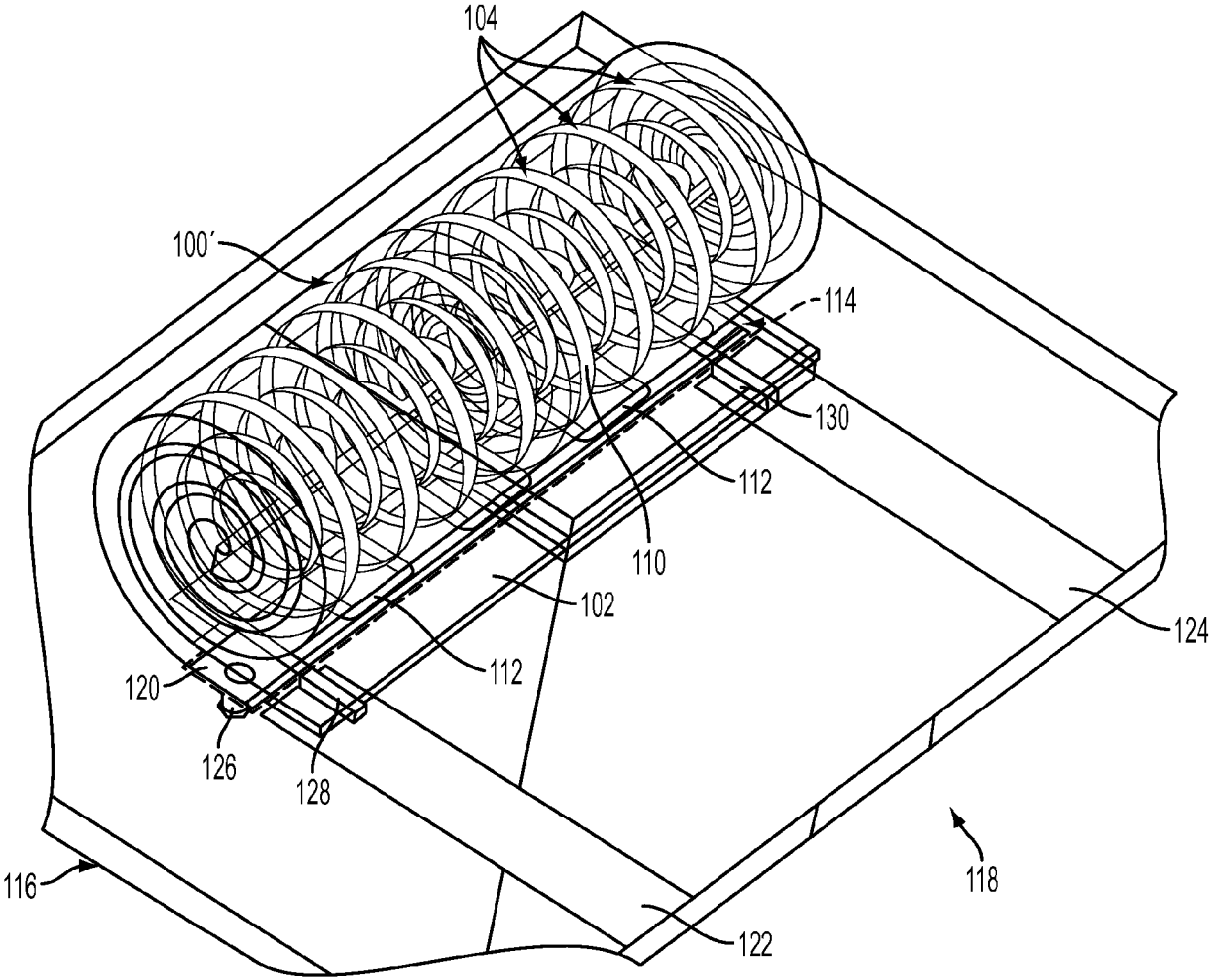
FIG. 3A is a perspective view of a three-dimensional coiled stripline coupled to a PWB to form a time delay unit of an antenna according to an embodiment.
Figure 3B:
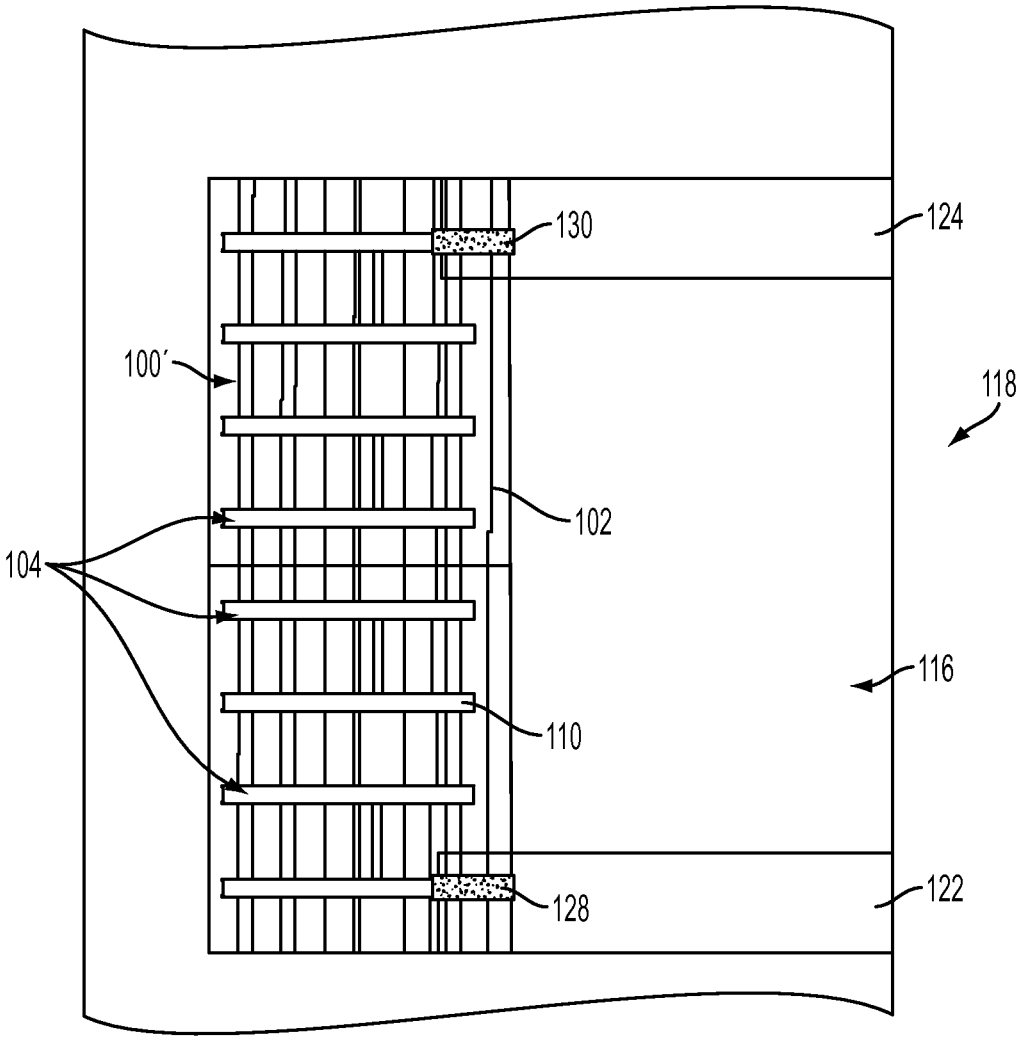
FIG. 3B is a top view of the three-dimensional coiled stripline coupled to the PWB illustrated in FIG. 3A.

Turning now to FIGS. 3A and 3B, a three-dimensional jelly roll stripline 100' is conductively connected (e.g., soldered) to a PWB 116 to form a time delay unit 118. Although a time delay unit 118 is described going forward, it is appreciated that the jelly roll stripline 100' can be implemented in other electronic circuits including, but not limited to, radio frequency (RF) filters and other RF circuits.

The PWB 116 is fabricated according to well-known fabrication methods and includes a ground strip 120 (FIG. 3A), a first board trace 122, and a second board trace 124. The ground strip 120 (FIG. 3A) in the PWB 116 includes one or more vias 126 (FIG. 2A) that extend through the PWB 116 and are configured to contact a ground plane (not shown) formed on an opposite side of the PWB 116. According to an embodiment, the ground strip 120 is aligned with the ground strip region 114 (FIG. 3A) of the stripline 100' and attached to the PWB 116 using a conventional method such as silver-filled adhesive or solder to simultaneously form a mechanical and electrical connection. In this way, the ground layer of the jelly roll stripline 100' is electrically connected to the ground layer of the PWB 116.

Figure 5:
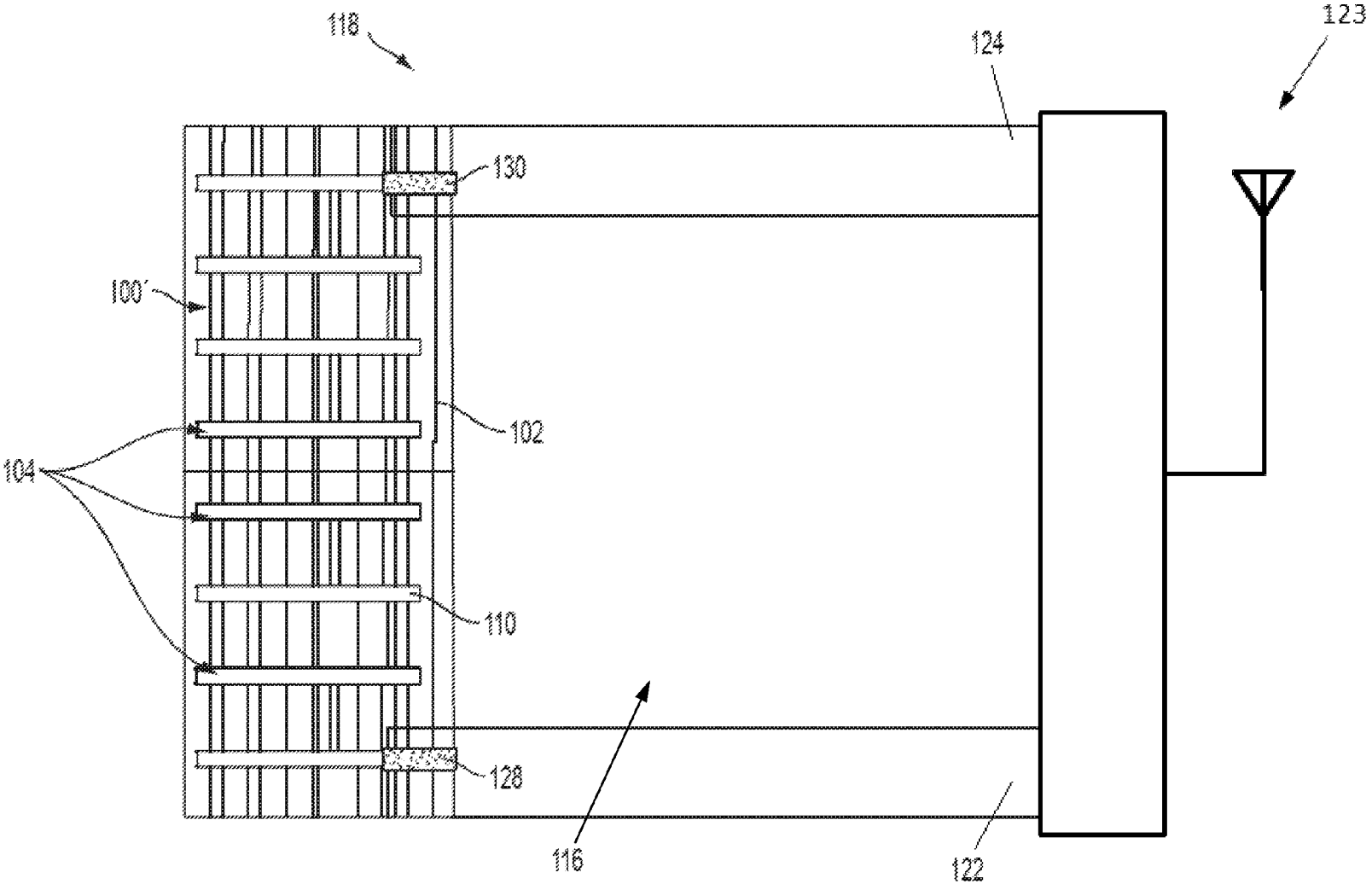
FIG. 5 is a block diagram illustrating a time delay unit including a first distal end of a first board trace and a second distal end of a second board trace each connected to an RF antenna.

A proximate end of the first board trace 122 is conductively connected to the first terminal end of the jelly roll stripline 100' via a first contact 128. A proximate end of the second board trace 124 is conductively connected to the second terminal end of the jelly roll stripline 100' via a second contact 130. The first and second contacts 128/130 include, for example, solder pads or a wirebond connection element. Distal ends of the first and second board traces 122/124 can be connected to an RF antenna 123. The time delay unit 118 can provide a time delay value that controls the frequency range of the RF antenna 123 see FIG. 5). Accordingly, the time delay unit allows a connected RF antenna 123 to operate over a broad range of frequencies.

Figure 4:
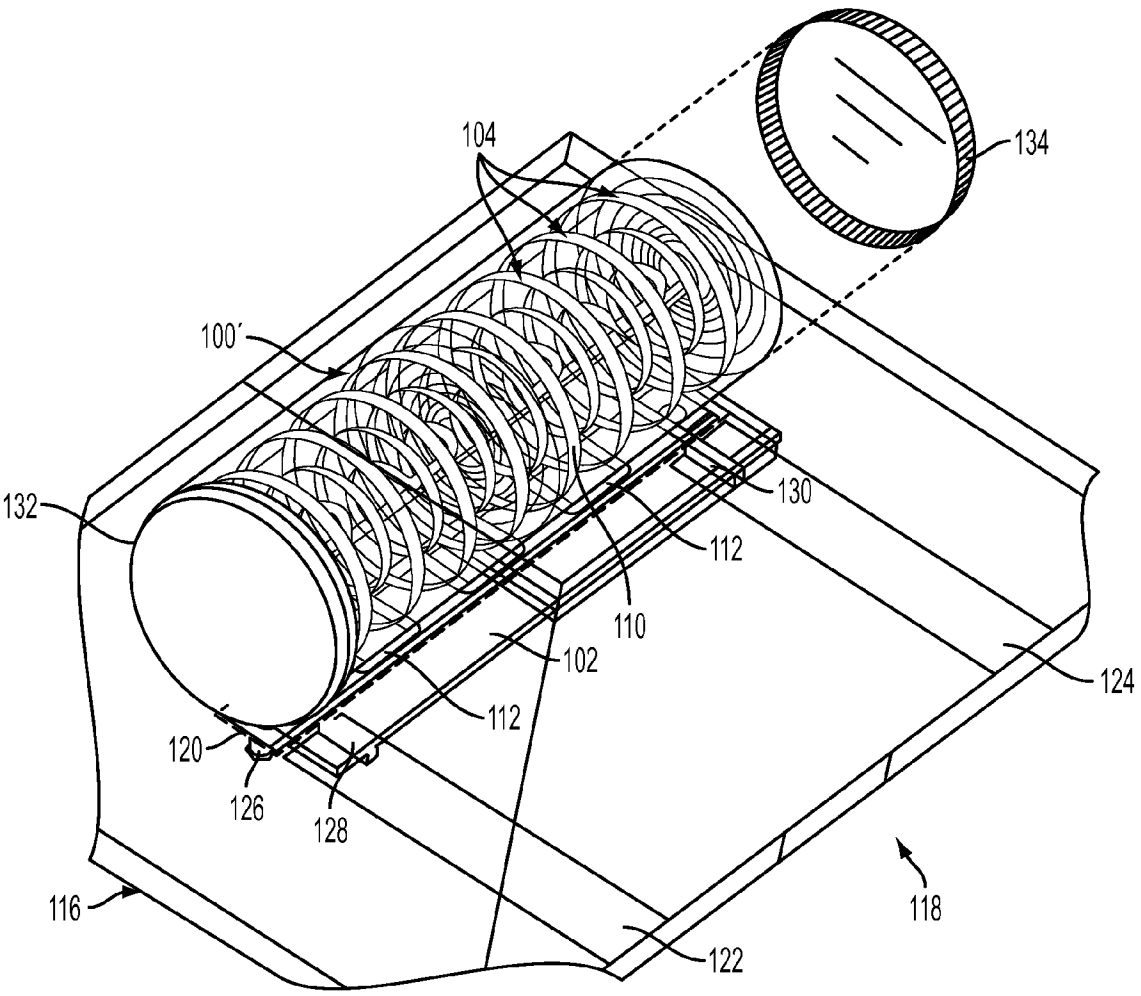
FIG. 4 is a perspective view of a three-dimensional coiled stripline including a pair of opposing edge wraps to ground a point of the stripline to a ground plane on the PWB according to an embodiment.

Referring now to FIG. 4, the time delay unit 118 includes one or more edge wraps 132/134 formed on opposing ends of the jelly roll stripline 100'. The edge wraps 132/134 are configured to connect all of the ground layers of the jelly roll stripline 100' so the distance to the PWB 116 ground is minimized for optimal RF performance. According to an embodiment, the edge wraps 132/134 can be formed by applying a layer of metal nanopaste to each end of the jelly roll stripline 100'. One method to accomplish this is to dip each end into a layer of nanopaste. The metal nanopaste is then sintered to form an integrated metallic connection. The metal nanopaste can be formed from various metallic materials including, but not limited to silver, copper, or gold. In this manner, the edge wraps eliminate the need for additional vias which are prone to cracking during fabrication. In contrast to microstrip or other open time delay configurations, the closed ground structure provided by the edge wraps 132/134 shield the jelly roll stripline 100' to prevent coupling to the other components in the overall time delay design. Furthermore, unlike various embodiments of the invention, conventional circuits that exclude the edge wraps 132/134 require vias formed in the top dielectric layer. Consequently, the top layer must be aligned with the bottom layer, thereby complicating fabrication.

The time delay unit 118 operates according to a broad frequency range. A limit of the time delay unit 119 can be determined by the structure of the jelly roll stripline 100' and the transitions to the PWB 116. For example, the limit of the time delay unit 118 can be controlled by the bandwidth of the transition and the onset of higher order mode propagation in the jelly roll stripline 100'. According to a non-limiting embodiment, the time delay unit 118 operates for time delay down to DC (0 Hz) and is a low pass structure that is limited by the transition structure to the PWB 116.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While the preferred embodiments to the invention have been described, it will be understood that those skilled in the art, both now and in the future, may make various modifications which fall within the scope of the claims which follow. These claims should be construed to maintain the proper protection for the invention first described.

What is claimed is:

1. An electronic stripline circuit, comprising:

a flexible dielectric film having a three-dimensional coiled shape that defines a spiraled inner core;

at least one electrically conductive signal trace formed on a first surface of the flexible dielectric film, the signal trace extending along a signal path to define a trace length configured to control a time delay of a coiled time delay unit, the at least one signal trace having a meandering pattern that extends between a first terminal end and a second terminal end formed on the stripline circuit; and a dielectric layer disposed on the at least one signal trace, wherein the flexible dielectric film comprises:

a first metal clad layer having a ground plane formed thereon; and a second metal clad layer including the at least one signal trace formed thereon.

2. The stripline circuit of claim 1, wherein the dielectric layer is formed from a flexible liquid crystal polymer material.

3. The stripline circuit of claim 2, wherein a second dielectric layer covers a first portion of the flexible dielectric film while exposing a second portion of the flexible dielectric film.

4. The stripline circuit of claim 3, wherein the exposed second portion is located between the dielectric layer and the first and second terminal ends.

5. The stripline circuit of claim 4, wherein the first terminal end and the second terminal end are disposed on a common side of the flexible dielectric film.

6. The stripline circuit of claim 5, wherein the at least one signal trace meanders between the first and second terminal ends, and in a direction extending along a width of the flexible dielectric film to form a plurality of lengthwise portions extending perpendicular to the width, the lengthwise portions separated by each other by a respective bent portion extending perpendicular to the lengthwise portions.

7. The stripline circuit of claim 6, wherein the flexible dielectric film is formed from a liquid crystal polymer (LCP).

8. A time delay unit, comprising:

an electrically conductive stripline including at least one electrically conductive signal trace formed thereon, the stripline having a three-dimensional coiled shape that defines a spiraled inner core and including a flexible dielectric film having the at least one signal trace formed therein;

a printed wiring board including at least one electrically conductive board trace in conductive contact with the at least one signal trace; and a dielectric layer disposed on the at least one signal trace, wherein the flexible dielectric film comprises:

a first metal clad layer having a ground plane formed thereon; and a second metal clad layer including the at least one signal trace formed thereon, the signal trace having a meandering pattern that extends between a first terminal end and a second terminal end.

9. The time delay unit of claim 8, wherein the at least one board trace includes a first board trace having a first proximate end connected to the first terminal end, and a second board trace having a second proximate end connected to the second terminal end.

10. The time delay unit of claim 9, wherein a first distal end of the first board trace and a second distal end of the second board trace are each connected to an RF antenna.

11. The time delay unit of claim 10, wherein the time delay unit is configured to provide a time delay value that controls the frequency range of the RF antenna.

12. The time delay unit of claim 11, wherein the time delay unit includes at least one edge wrap formed on a respective end of the stripline, the at least one edge wrap configured to minimize the distance between the ground layer of the flexible dielectric film and the ground layer of the board.

13. The time delay unit of claim 12, wherein the at least one edge wrap includes a first edge wrap formed on a first end of the stripline and a second edge wrap formed on a second end of the stripline opposite the first end, the first and second edge wraps connecting together the ground layers of the stripline.

* * * * *